US011011852B2

(12) United States Patent
Harel

(10) Patent No.: US 11,011,852 B2
(45) Date of Patent: May 18, 2021

(54) ANTENNA SYSTEM

(71) Applicant: NOKIA SHANGHAI BELL CO., LTD., Shanghai (CN)

(72) Inventor: Jean-Pierre Harel, Lannion (FR)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 0 days.

(21) Appl. No.: 16/420,495

(22) Filed: May 23, 2019

(65) Prior Publication Data

US 2019/0363451 A1 Nov. 28, 2019

(30) Foreign Application Priority Data

May 24, 2018 (EP) ..... 18174184

(51) Int. Cl.
*H01Q 21/00* (2006.01)
*H01Q 5/40* (2015.01)

(52) U.S. Cl.
CPC ..... *H01Q 21/0025* (2013.01); *H01Q 5/40* (2015.01)

(58) Field of Classification Search
None
See application file for complete search history.

(56) References Cited

U.S. PATENT DOCUMENTS

| | | | | |
|---|---|---|---|---|
| 4,218,685 | A | 8/1980 | Frosch | |
| 6,956,537 | B2 * | 10/2005 | Scherzer | H01Q 1/246 343/754 |
| 10,270,159 | B1 | 4/2019 | Bryce | |
| 2015/0091777 | A1 * | 4/2015 | Rucki | H01Q 1/246 343/872 |
| 2016/0119796 | A1 * | 4/2016 | Ho | H04B 1/40 370/328 |

FOREIGN PATENT DOCUMENTS

| | | | |
|---|---|---|---|
| CN | 1010808851 | A | 11/2007 |
| CN | 102714345 | A | 10/2012 |
| CN | 104901025 | A | 9/2015 |
| JP | 2018029298 | A | 2/2018 |
| KR | 101615751 | B1 | 4/2016 |
| WO | 2012/103821 | A2 | 8/2012 |

OTHER PUBLICATIONS

Dec. 21, 2019 Office Action issued in Korean Patent Application No. 10-2019-0061015.
Aug. 3, 2020 Office Action issued in Chinese Patent Application No. 201910434849.2.
European Office Action issued in corresponding European Patent Application No. 18 174 184.4-1205 dated Mar. 5, 2021.
Chinese Office Action issued in corresponding Chinese Patent Application No. 201910434849.2 dated Mar. 16, 2021.

* cited by examiner

*Primary Examiner* — Anh Q Tran

(74) *Attorney, Agent, or Firm* — Squire Patton Boggs (US) LLP

(57) ABSTRACT

A reconfigurable modular antenna system includes a first module comprising at least a first part of a first antenna system, and a second replaceable module comprising at least a second part of a first antenna system and a part of a second antenna system. An interconnect is disposed between the first module and the second replaceable module and couples the first part of the first antenna system to the second part of the first antenna system to form the first antenna system. The first antenna system is configured to operate in a first frequency band and the second antenna system is configured to operate in a second frequency band, different to the first frequency band.

15 Claims, 3 Drawing Sheets

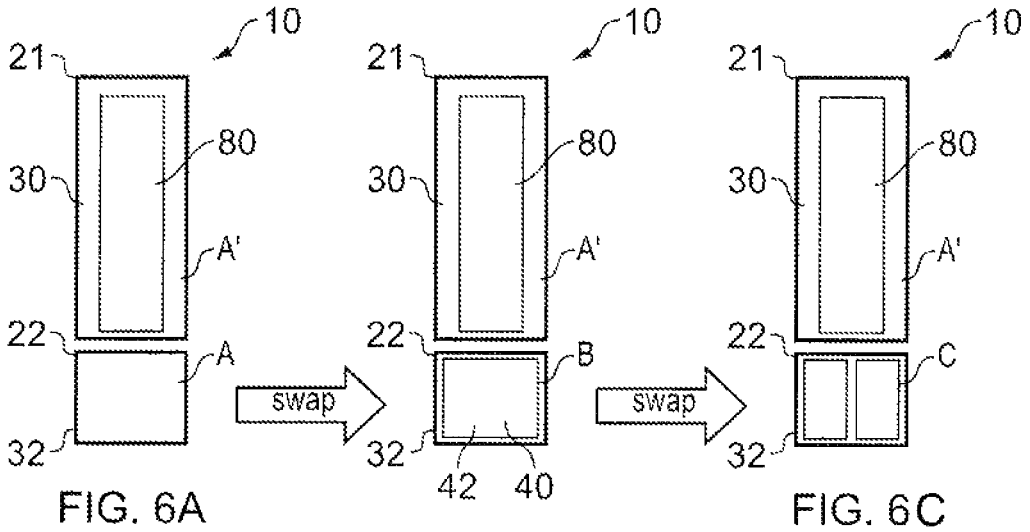
FIG. 6A
FIG. 6B
FIG. 6C
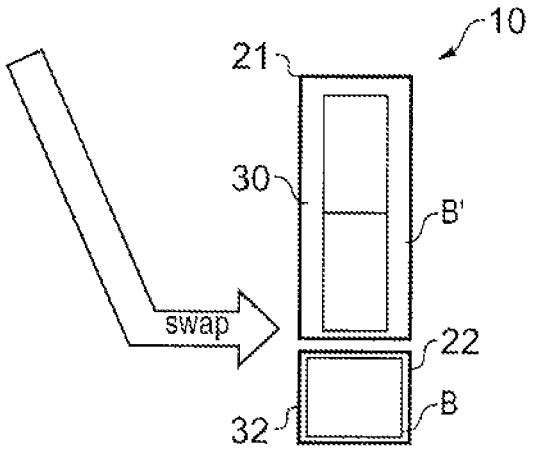
FIG. 6D

ANTENNA SYSTEM

TECHNOLOGICAL FIELD

Some embodiments of the present disclosure relate to an antenna system. Some embodiments of the present disclosure relate to a modular antenna system and modules for a modular antenna system.

BACKGROUND

An antenna system is configured to operate in one or more operational frequency bands. The gain of the antenna system is frequency-dependent and is higher within the one or more operational frequency bands than at other adjacent frequencies. The antenna system is therefore configured to transmit and/or receive electromagnetic waves within the one or more operational frequency bands.

BRIEF SUMMARY

According to various, but not necessarily all, embodiments there is provided a reconfigurable modular antenna system comprising: a first module comprising at least a first part of a first antenna system; a second replaceable module comprising at least a second part of a first antenna system and a part of a second antenna system; and an interconnect between the first module and the second replaceable module that couples the first part of the first antenna system to the second part of the first antenna system to form the first antenna system, wherein the first antenna system is configured to operate in a first frequency band and the second antenna system is configured to operate in a second frequency band, different to the first frequency band.

Advantages of at least some examples of the reconfigurable modular antenna system include that antenna systems can be upgraded without increasing their size. This achieved by using one or more replaceable modules.

In some but not necessarily all examples, the first module is a replaceable module.

In some but not necessarily all examples, the second replaceable module is configured to be on-site replaceable or wherein the second replaceable module and the first module are both configured to be on-site replaceable.

In some but not necessarily all examples, at least the second replaceable module is configured to be replaceable while the first module continues to operate.

In some but not necessarily all examples, the first module comprises no part of the second antenna system.

In some but not necessarily all examples, the second antenna system is comprised wholly within the second replaceable module.

In some but not necessarily all examples, the second antenna system is comprised of a first part in the second replaceable module and another part in a different module comprised within the reconfigurable modular antenna system.

In some but not necessarily all examples, the second replaceable module comprises radiator elements that are common between the first antenna system and the second antenna system.

In some but not necessarily all examples, the second replaceable module comprises radiator elements of the first antenna system that are interleaved with radiator elements of the second antenna system.

In some but not necessarily all examples, the first module comprises radiator elements of the first antenna system interleaved with the radiator elements of a third antenna system.

In some but not necessarily all examples, the interleaving of radiator elements comprises a first array of groups of higher frequency radiator elements, each group of higher frequency radiator elements being configured to lie, within surrounding conductive separation walls, on different arms of group-dependent virtual cross motifs aligned with and inclined at 45° to a common axis; and a second array of groups of lower frequency radiator elements, each group of lower frequency radiator elements being configured to lie, outside one of the surrounding conductive separation walls, and different arms of group-dependent virtual cross motifs aligned with and inclined at 45° to the common axis.

In some but not necessarily all examples, radiator elements of the system are arranged in a two-dimensional plane as a radiator element panel.

In some but not necessarily all examples, the first antenna system is a passive antenna system and the second antenna system is a passive antenna system.

In some but not necessarily all examples, the first antenna system is a passive antenna system and the second antenna system is an active antenna system. In some but not necessarily all examples, the second antenna system, being an active antenna system, comprises a two-dimensional array of radiator elements. In some but not necessarily all examples, the reconfigurable modular antenna system comprises active circuitry configured for digital beam forming.

In some but not necessarily all examples, the first module comprises an additional third antenna system.

In some but not necessarily all examples, the first antenna system and the second antenna system operate at frequencies below 6 GHz.

In some but not necessarily all examples, the reconfigurable modular antenna system is housed within a common radome and comprises means for separately mounting the first module and the second replaceable module.

In some but not necessarily all examples, a cellular base station comprises the reconfigurable modular antenna.

According to various, but not necessarily all, embodiments there is provided a replaceable module of a reconfigurable modular antenna system, comprising at least a first part of a first antenna system having an interface for an interconnect for coupling the first part of the first antenna system to a second part of the first antenna system in a second module to form the first antenna system configured to operate in a first frequency band wherein the system comprises at least:

the replaceable module;

the second module comprising at least the second part of the first antenna system and a part of a second antenna system; and an interconnect between the first replaceable module and the second module that couples the first part of the first antenna system to the second part of the first antenna system to form the first antenna system, wherein the second antenna system is configured to operate in a second frequency band, different to the first frequency band.

According to various, but not necessarily all, embodiments there is provided a replaceable module of a reconfigurable modular antenna system, comprising at least a part of a second antenna system and a part of a first antenna system having an interface for an interconnect for coupling the part of the first antenna system to another part of the first antenna system in another module to form the first antenna system being configured to operate in a first frequency band, wherein the system comprises at least:

the replaceable module;

the another module comprising at least the another part of the first antenna system;

an interconnect between the replaceable module and the another module that couples the part of the first antenna system to the another part of the first antenna system to form the first antenna system, wherein the second antenna system is configured to operate in a second frequency band, different to the first frequency band.

According to various, but not necessarily all, embodiments there is provided a reconfigurable antenna system comprising:

a first antenna system comprising a first part and a second part;

the second part further comprising at least a part of a second antenna system and an interconnect between the first part and the second part that couples the first part of the first antenna system to the second part of the first antenna system to form the first antenna system, wherein the first antenna system is configured to operate in a first frequency band and the second antenna system is configured to operate in a second frequency band, different to the first frequency band.

According to various, but not necessarily all, embodiments there is provided a reconfigurable antenna system comprising:

a first antenna system comprised in a first module and a second replaceable module;

the second replaceable module further comprising at least a part of a second antenna system and an interconnect between the first module and the second replaceable module that couples a part of the first antenna system in the first module to a part of the first antenna system in the second replaceable module to form the first antenna system.

wherein the first antenna system is configured to operate in a first frequency band and the second antenna system is configured to operate in a second frequency band, different to the first frequency band.

According to various, but not necessarily all, embodiments there is provided examples as claimed in the appended claims.

BRIEF DESCRIPTION

Some example embodiments will now be described with reference to the accompanying drawings in which:

FIG. 6A, 6B, 6C, 6D show other example embodiments of the subject matter described herein;

DETAILED DESCRIPTION

Figure 1:
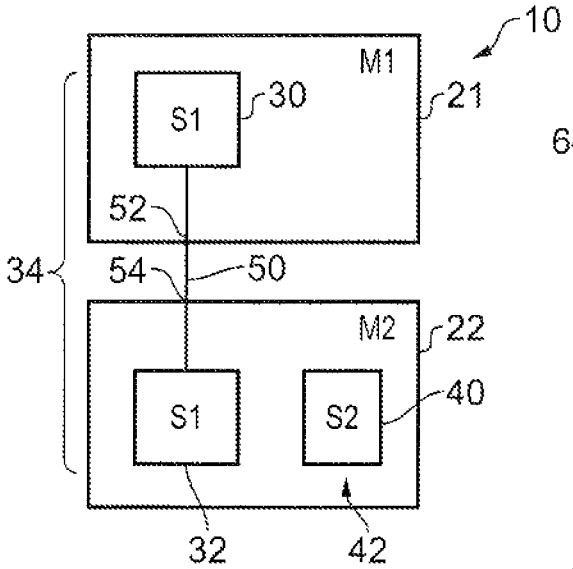
FIG. 1 shows an example embodiment of the subject matter described herein.

FIG. 1 illustrates an example of a reconfigurable modular antenna system 10.

The system 10 is an antenna system because it comprises at least a first antenna system 34 and a second antenna system 42.

Figure 2:
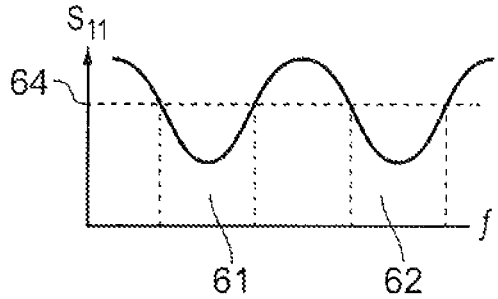
FIG. 2 shows another example embodiment of the subject matter described herein.

The first antenna system 34 is configured to operate in at least a first frequency band 61 (see FIG. 2, for an example). The gain of the first antenna system 34 is frequency-dependent and is higher within the first frequency band than at least some other adjacent frequencies. The first antenna system 34 is therefore configured to transmit and/or receive electromagnetic waves within the first frequency band.

The second antenna system 42 is configured to operate in at least a second frequency band 62 (see FIG. 2, for an example). The gain of the second antenna system 42 is frequency-dependent and is higher within the second frequency band than at least some other adjacent frequencies. The second antenna system 42 is therefore configured to transmit and/or receive electromagnetic waves within the second frequency band.

The second frequency band is different to the first frequency band.

The system 10 is modular because it comprises at least a first module 21 and a second module 22.

As used here 'module' refers to a part of the system 10 that excludes certain other parts or components that would be added to create the system. In some examples the module may be one or more components. The components may be preassembled as a collection of components. In some examples the component or collection of components may comprise a structural element that holds the collection of components together or protects the component or collection of components or enables the handling of the collection of components as a single entity. For example, the structural entity could be a protective cover that covers at least some of the module and provides some protection or could be a support that holds or positions components such as radiator elements or could be a housing that allows transportation of components.

At least the first antenna system 34 is a multi-part antenna system. A multi-part antenna system can have two or more parts interconnected, for example, by one or more interconnects 50. In the example illustrated the first antenna system 34 has two parts—a first part 30 and a second part 32.

The second antenna system 42 may be a multi-part antenna system but in the illustrated example is a single part antenna system that has one part—part 40.

The first module 21 comprises at least a first part 30 of the first antenna system 34.

In the example illustrated, but not necessarily all examples, the first module 21 comprises the first part 30 of the first antenna system 34 and does not comprise any part of the second antenna system 42.

The second module 22 comprises at least a second part 32 of the first antenna system 34 and a part 40 of the second antenna system 42. In the example illustrated, but not necessarily all examples, the second module 22 comprises the second part 32 of the first antenna system 34 and comprise all of the second antenna system 42.

An interconnect 50 between the first module 21 and the second module 22 couples the first part 30 of the first antenna system 34 to the second part 32 of the first antenna system 34 to form the first antenna system 34. The interconnect 50 may, for example, be a physical interconnect or a non-contact interconnect. A physical interconnect 50 can be any suitable physical interconnection for functionally coupling the parts such as a jumper, transmission line, waveguide, conductor etc. The physical interconnect 50 can, for example, comprise one or more conductors. A non-contact interconnect 50 can be any suitable non-physical interconnection for coupling the parts such as an arrangement for electromagnetic coupling. The non-contact interconnect 50 can, for example, comprise a capacitive coupler or an inductive coupler.

The system 10 is reconfigurable because at least the second module 22 is a replaceable module. That is the second module 22 can be replaced with a different second module 22.

A reconfigurable system can also be upgradeable. An upgradeable antenna system is capable of being upgraded at any point in the future from a first configuration to a second configuration. The second configuration can have, for example, an increase/decrease in frequency bands covered by the whole antenna system and/or a radio frequency performance improvement.

In some but not necessarily all examples some or all of other modules, for example, the first module 21 are also replaceable.

For example, an incumbent second replaceable module 22 could have a second antenna system 42 that operates in a second frequency band, where the second frequency band is defined between frequencies f1 and f2. The incumbent second replaceable module 22 can be removed and replaced by, for example, another second replaceable module 22 that has a different second frequency band (which is still different to the first frequency band). The new second replaceable module 22 could have a second antenna system 42 that operates in a second frequency band, where the second frequency band is defined between frequencies f3 and f4 (where f3 is different to f1 and f2 and/or f4 is different to f1 and f2).

The new second module 22 is a second module 22 comprising at least the second part 32 of the first antenna system 34 and a part 40 of the second antenna system 42. In some examples, but not necessarily all examples, the second module 22 comprises all of the second antenna system 42.

The reconfigurable modular antenna system 10 is flexible as at least the second replaceable module 22 can be swapped for another second replaceable module 22 that is also connected by interconnect 50 and that provides different functionality compared to the original second module while still completing the first antenna system 34. This flexibility has significant advantages because upgrades or changes or bespoke designs can be provided straightforwardly.

Another advantage is that a fixed volume for a given mast/tower antenna installation (which cannot be increased in size) can be updated adding further frequency bands by adding modules and/or replacing some or all of the original antenna array (which may not be modular) with a modular antenna system 10 while adding further operational frequency bands.

In some but not necessarily all examples, the replaceable modules, for example the second replaceable module 22, that are used to replace an incumbent module have the same size, meaning exactly or substantially the same size, as the module that is replaced. Size in this sense may mean a single dimension, a combination of dimensions, a volume, a cross-section or all external measurements. It is therefore possible to constrain or prevent size increases as a result of swapping modules. This has significant advantages in densely packed cellular base stations that host a system 10.

In some but not necessarily all examples, the system 10 may be configured to allow continuing operation of at least one antenna system while a replaceable module is being replaced. For example, in some examples but not necessarily all examples, the second replaceable module 22 is configured to be replaceable while the first module 21 continues to operate. For example, in some examples but not necessarily all examples, the first module 21 is configured to be replaceable while the second replaceable module 22 continues to operate.

From the foregoing, it will therefore be understood that in some, but not necessarily all examples, the first module 21 is a replaceable module of a reconfigurable modular antenna system 10. The first module 21 comprises at least a first part 30 of a first antenna system 34 and has an interface 52 for an interconnect 50 for coupling the first part 30 of the first antenna system 34 to a second part 32 of the first antenna system 34 in a second module 22 to form the first antenna system 34, which is configured to operate in a first frequency band 61. The system 10 comprises at least: the replaceable module 21; the second module 22 comprising at least the second part 32 of the first antenna system 34 and a part 40 of a second antenna system 42; and an interconnect 50 between the first replaceable module 21 and the second module 22 that couples the first part 30 of the first antenna system 34 to the second part 32 of the first antenna system 34 to form the first antenna system 34. The second antenna system 42 is configured to operate in a second frequency band 62, different to the first frequency band 61. The second module 22 can, in some examples, be a replaceable module.

From the foregoing, it will therefore be understood that in some, but not necessarily all examples, the second module 22 is a replaceable module of a reconfigurable modular antenna system 10. The second module 22 comprises at least a part 40 of a second antenna system 42 and a part 32 of a first antenna system 34. the second module 22 has an interface 54 for an interconnect 50 for coupling the part 32 of the first antenna system 34 to another part 30 of the first antenna system 34 in another module 21 to form the first antenna system 34, which is configured to operate in a first frequency band 61. The system 10 comprises at least: the replaceable module 22; the another module 21 comprising at least the another part 30 of the first antenna system 34; an interconnect 50 between the replaceable module 22 and the another module 21 that couples the part 32 of the first antenna system 34 to the another part 30 of the first antenna system 34 to form the first antenna system 10. The second antenna system 42 is configured to operate in a second frequency band 62, different to the first frequency band 61.

An example of a first frequency band 61 and a second frequency band 62 is illustrated in FIG. 2.

In this example, but not necessarily all examples the frequencies within the first frequency band 61 are lower than the frequencies within the second frequency band 62. In other examples the frequencies within the first frequency band 61 are higher than the frequencies within the second frequency band 62.

In this example, but not necessarily all examples, the frequencies within the first frequency band 61 and the frequencies within the second frequency band 62 do not overlap. In other examples, the frequencies within the first frequency band 61 and the frequencies within the second frequency band 62 partially or fully overlap. In some examples, the first frequency band 61 or the second frequency band 62 is an ultrawide band.

The operational frequency bands, for example the first frequency band 61 and the second frequency band 62 may be within or cover a low band (0.7 to 0.96 GHz), a high band (1.7 to 2.7 GHz) or a very high band (3.3 to 3.8 GHz).

The operational frequency bands, for example the first frequency band 61 and the second frequency band 62 may be within or cover (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz) and frequency bands for 5G.

A frequency band over which an antenna can efficiently operate is a frequency range where the antenna's return loss is less than an operational threshold 64. For example, efficient operation may occur when the antenna's return loss S11 is better than (that is, less than) −10 dB or −14 dB.

An operational resonant mode (operational bandwidth) of a radiating element may be defined as where the return loss S11 of the radiating element is better than an operational threshold T such as, for example, −10 or −14 dB.

Figure 3:
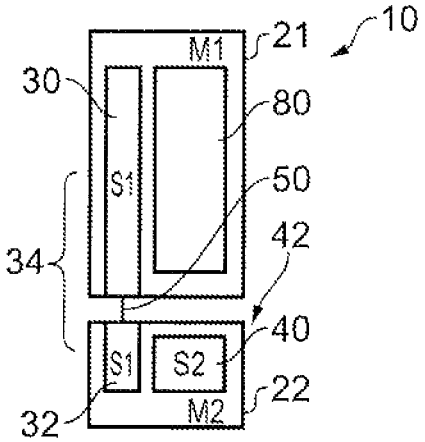
FIG. 3 shows an example embodiment of the subject matter described herein.

FIG. 3 illustrates another example of the system 10 as illustrated in and described with reference to FIG. 1. The description of the system 10 for FIG. 1 is also relevant to FIG. 3 and similar references are used to denote similar features.

The reconfigurable modular antenna system 10 in FIG. 3 is different in that the first module 21 comprises an additional third antenna system 80. As in FIG. 1, the first module 21 comprises no part of the second antenna system 42. The second antenna system 42 is comprised wholly within the second replaceable module 22.

In an alternative version, the reconfigurable modular antenna system 10 in FIG. 3 is different in that the first module 21 comprises an additional part 80 of the second antenna system 42 in the first module 21. The first module 21 comprises a part of the second antenna system 42, and the second antenna system 42 is comprised within the first module 21 and second replaceable module 22 and interconnected by the interconnect 50.

Figure 4:
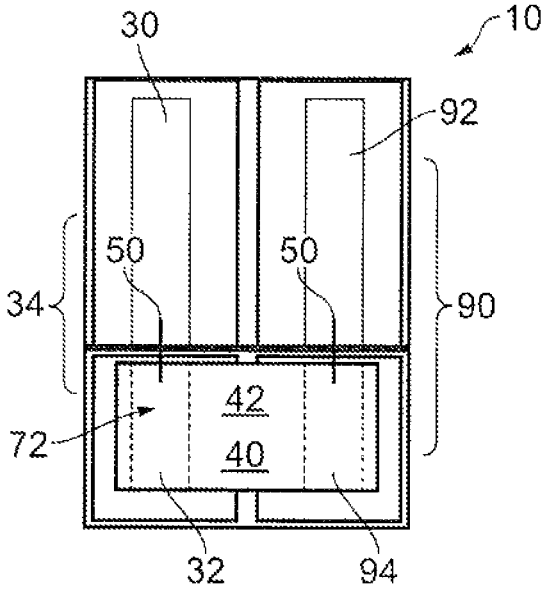
FIG. 4 shows another example embodiment of the subject matter described herein.

FIG. 4 illustrates another example of the system 10 as illustrated in and described with reference to FIG. 1. The description of the system 10 for FIG. 1 is also relevant to FIG. 4 and similar references are used to denote similar features.

The reconfigurable modular antenna system 10 in FIG. 4 is different in that the second replaceable module 22 comprises radiator elements 72 that are common between the first antenna system 34 and the second antenna system 42. In this example, the second frequency range 62 may overlap wholly the first frequency range 61. The second frequency range may, for example, be ultrabroadband.

In the example illustrated the system 10 has an additional third antenna system. The third antenna system 90 is similar to the first antenna system 34 in that it comprises a first part 92 in the first module 21 interconnected by an interconnect 50 to a second part 94 in the second module. It is also similar in that it operates in a narrow band frequency range that is entirely overlapped by the second frequency band 62. It is different in that the third frequency band is different to the first frequency band.

The first frequency band may be within the low band (0.7 to 0.96 GHz) or the high band (1.7 to 2.7 GHz). The third frequency band may be within the low band (0.7 to 0.96 GHz) or the high band (1.7 to 2.7 GHz). The second frequency band may cover the very high band (3.3 to 3.8 GHz).

In some but not necessarily all examples, in the second module 22, the radiator elements 72 of the first antenna system 34 are interleaved with radiator elements 72 of the second antenna system 42.

In some but not necessarily all examples, in the first module 21, the radiator elements 72 of the first antenna system 34 are interleaved with the radiator elements 72 of a third antenna system.

The radiator elements 72 of the system 10 in any of the examples described, can be (but are not necessarily) arranged in a two-dimensional plane as a radiator element panel. Examples of radiator elements 72 arranged in a two-dimensional plane as a radiator element panel are illustrated in FIG. 5, which illustrates interleaved radiator elements, and in FIG. 8, which illustrates a grid array of radiator elements 72 that could be used for Multiple-input Multiple-output (MIMO) and/or beamforming.

Figure 5:
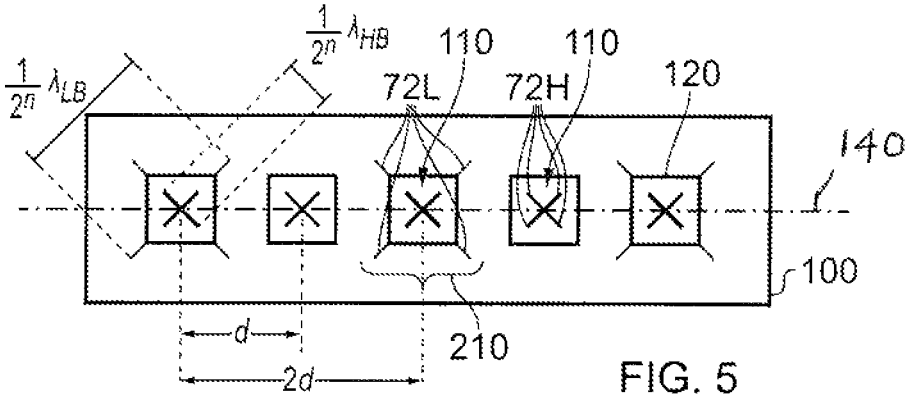
FIG. 5 shows an example embodiment of the subject matter described herein.

FIG. 5 illustrates an example of one type of interleaved structure 100 comprising interleaving of radiator elements 72.

The interleaved structure 100 comprises a first array of groups 110 of higher frequency radiator elements 72H and a second array of groups 210 of lower frequency radiator elements 72L.

The first array of high-frequency groups 110 of higher frequency radiator elements 72H provides at least a part of a higher frequency antenna system.

The second array of low-frequency groups 210 of lower frequency radiator elements 72L provides at least a part of a lower frequency antenna system.

In some examples, the higher frequency antenna system is the second antenna system 42 and the lower frequency antenna system is the first antenna system 34.

In other examples, the higher frequency antenna system is one of the first antenna system 34 and the third antenna system 90 and the lower frequency antenna system is the other one of the first antenna system 34 and the third antenna system 90.

In this illustrated example, but not necessarily all examples, each high-frequency group 110 of higher frequency radiator elements 72H has the same arrangement of higher frequency radiator elements 72H.

In this example, but not necessarily all examples, each high-frequency group 110 of higher frequency radiator elements 72H is spaced regularly at a distance d along the common axis 140.

Each high-frequency group 110 of higher frequency radiator elements 72H is configured to lie on different arms of a virtual cross motif aligned with and inclined at 45° to a common axis 140. The arms of each virtual cross motif are mutually orthogonal and meet at a center. The centers of the virtual cross motifs of the high-frequency groups 110 are regularly spaced at a distance d along the common axis 140.

Each higher frequency radiator element 72H of a high-frequency group 110 has the same size and the same spacing (if any) from the group-center on the common axis 140 but is oriented at 90° relative to the two adjacent higher frequency radiator element 72H of the same high-frequency group 110 and 180° relative to the opposing higher frequency radiator element 72H of the same high-frequency group 110.

Each high-frequency group 110 of higher frequency radiator elements 72H is configured to lie, within surrounding conductive separation walls 120, that form an enclosure in two-dimensions.

In this illustrated example, but not necessarily all examples, each low-frequency group 210 of lower frequency radiator elements 72L has the same arrangement of lower frequency radiator elements 72L.

In this example, but not necessarily all examples, each low-frequency group 210 of lower frequency radiator elements 72L is spaced regularly at a distance m*d along the common axis 140, where m is a natural number greater than 1. In this example m=2.

Each low-frequency group 210 of lower frequency radiator elements 72L is configured to lie on different arms of a virtual cross motif aligned with and inclined at 45° to a common axis 140. The arms of each virtual cross motif are mutually orthogonal and meet at a center. The centers of the virtual cross motifs of the low-frequency groups 210 are regularly spaced at a distance m*d along the common axis 140.

Each lower frequency radiator element 72L of a low-frequency group 210 has the same size and the same spacing from the group-center on the common axis 140 but is oriented at 90° relative to the two adjacent lower frequency radiator element 72L of the same low-frequency group 210 and 180° relative to the opposing lower frequency radiator element 72L of the same low-frequency group 210.

Each low-frequency group 210 of lower frequency radiator elements 72L is configured to lie, outside the conductive separation walls 120, that form an enclosure in two-dimensions. Each low-frequency group 210 of lower frequency radiator elements 72L may be configured to lie, at the corners of a rectangle enclosure formed by the conductive separation walls 120.

In this example, but not necessarily all examples, each group-center on the common axis 140 for a low-frequency group 210 coincides with a group-center on the common axis 140 for a high-frequency group 110.

In this example, but not necessarily all examples, the cross motif used for a low-frequency group 210 is also used for a high-frequency group 110.

Where m>2, multiple high frequency radiating elements 72H may be within each inscribing conductive separation wall 120.

The outer extremities of opposing lower frequency radiator elements 72L of the same low-frequency group 210 have a defined separation based upon a desired operational frequency band. For example, a central frequency of the band may be defined by $c/\lambda_{LB}$ and the separation may be $\lambda_{LB}/(2\hat{}n)$.

The outer extremities of opposing higher frequency radiator elements 72H of the same high-frequency group 110 have a defined separation based upon a desired operational frequency band. For example, a central frequency of the band may be defined by $c/\lambda_{HB}$ and the separation may be $\lambda_{HB}/(2\hat{}n)$.

The separation for the high-frequency group 110 is smaller than the separation for the lower frequency group 210.

FIG. 6A, 6B, 6C, 6D illustrate an example of a system 10 as previously described that is updated by swapping the incumbent second replaceable module 22 for a new second replaceable module 22.

In each of FIGS. 6A to 6D, the system 10 comprises a first module 21 (which may or may not be replaceable) and a second module 22 that is replaceable.

In each of the FIGs the first module 21 comprises a first part 30 of a first antenna system 34 and the second module 22 comprises a second part 32 of the first antenna system. The first part 30 of a first antenna system 34 is interconnected to the second module 22 via an interconnect 50 (not illustrated for clarity of illustration).

In each of the FIGs the first module 21 additionally comprises a third antenna system 80, for example as illustrated in FIG. 3. However, this is optional.

In FIG. 6A, the second replaceable module 22 (module A) comprises only the second part 32 of the first antenna system 34.

In FIG. 6B, the second replaceable module 22 (module A) has been replaced by a second replacement module 22 (module B) that comprises the second part 32 of the first antenna system 34 and, in addition a part 40 of a second antenna system 42. An interconnect 50 (not illustrated) interconnects the parts 30, 32 of the first antenna system 34. The module B is similar to the second replaceable module 22 illustrated in FIG. 1. The module A and the module B can have the same size (same footprint). In some but not necessarily all examples, the part 40 may for instance be longer than the part 32. The width of module 21 and module 22 can be the same. An advantage of this solution is that antenna lengths can remain constant despite other "antenna systems" being added In FIG. 6C, the second replaceable module 22 (module B) has been replaced by a second replacement module 22 (module C) that comprises the second part 32 of the first antenna system 34 and, in addition a part 40 of a second antenna system 42 and, in addition a part of a further antenna system. An interconnect 50 (not illustrated) interconnects the parts 30, 32 of the first antenna system 34. The module C and the module B have the same size (same footprint).

In FIG. 6D, the second replaceable module 22 (module B) has not been replaced by a second replacement module 22. However the first replaceable module 21 (module A') has been replaced by a new first replaceable module 21 (module B') that comprises the first part 32 of the first antenna system 34 and, is configured for extended or reduced functionality. An interconnect 50 (not illustrated) interconnects the parts 30, 32 of the first antenna system 34.

Figure 7A:
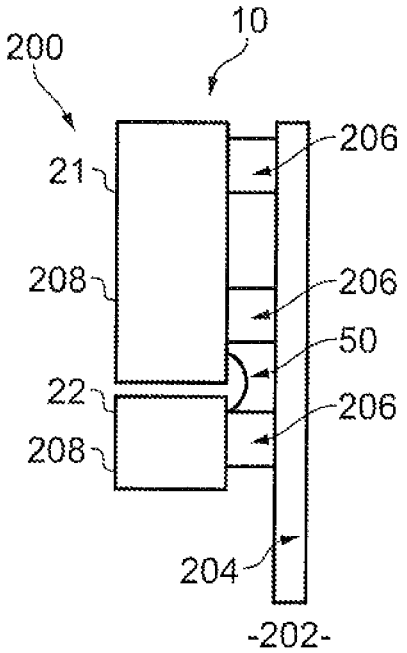
FIGS. 7A and 7B show other example embodiments of the subject matter described herein.

FIG. 7A illustrates an example of the system 10 in use at a cellular base station 200.

The cellular base station is located at a site 202. A mast 204 at the site 202 supports the system 10 via mounting hardware 206. The system 10 may also be used in other applications.

The first module 21 is a replaceable module attached to the mast 204 via the mounting hardware 206. The first replaceable module 21 and the mounting hardware 206 are configured to enable on-site replacement of the first module 21, for example, by an engineer or other person. In some but not necessarily all examples, the second replaceable module 22 is configured to continue operation while the first replaceable module 21 is being replaced.

The second module 22 is a replaceable module attached to the mast 204 via the mounting hardware 206. The second replaceable module 22 and the mounting hardware 206 are configured to enable on-site replacement of the second replaceable module 22 by an engineer. In some but not necessarily all examples, the first replaceable module 21 is configured to continue operation, if a fully operation mode or a reduced operational mode, while the second replaceable module 22 is being replaced.

In the example illustrated components have been preassembled, off-site, as a collection of components to form the first module 21. A structural element 208 protects the collection of components and enables the handling of the collection of components as a single entity. In this example, the structural element 208 is a housing that allows transportation of a collection of components and provides a protective cover.

In the example illustrated components have been preassembled, off-site, as a collection of components to form the second module 22. A structural element 208 protects the collection of components and enables the handling of the collection of components as a single entity. In this example, the structural element 208 is a housing that allows transportation of a collection of components and provides a protective cover.

Figure 7B:
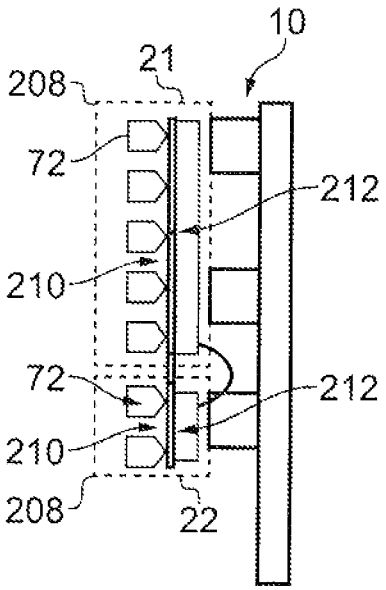

FIG. 7B illustrates an example of a collection of components within the housing 208 of the first module 21 and an example of a collection of components within the housing 208 of the second module 22.

A structural element 210, a chassis, holds the collection of components together in the first module 21. The chassis holds and positions components such as radiator elements 72 and additional passive (or active) components 212. In this example, the radiator elements 72 are arranged in a two-dimensional plane as a radiator element panel.

A structural element 210, a chassis, holds the collection of components together in the second module 22. The chassis holds and positions components such as radiator elements 72 and additional passive (or active) components 212. In this example, the radiator elements 72 are arranged in a two-dimensional plane as a radiator element panel.

The housing 208 as illustrated in FIGS. 7A and 7B is transparent to radio frequency waves at the frequencies of use.

In some examples the housings 208 may be external radomes.

In other examples, an external common radome may cover the housings 208 and be mounted on a mechanical frame that separately mounts the first module 21 and the second module 22.

In some but not necessarily all of the examples described above, the first antenna system 34 is a passive antenna system and the second antenna system 42 is a passive antenna system.

In some but not necessarily all of the examples described above, the first antenna system 34 is a passive antenna system and the second antenna system 42 is an active antenna system.

A passive antenna system uses passive components 212. A passive antenna system can, for example, be used at lower frequency band or where MIMO or digital beamforming is not required.

In some examples, a passive system is a one-dimensional array of radiating elements 72.

In some examples, a passive system is a multiband antenna system. It may for example comprise a one-dimensional array of radiating elements 72 for each frequency band. The two one-dimensional arrays of radiator elements 72 may be interleaved, for example, as illustrated in FIG. 5.

The first antenna system 34 may, for example, be used for lower frequency bands such as low band (0.7 to 0.96 GHz) and high band (1.7 to 2.7 GHz) but not very high band (3.3 to 3.8 GHz).

The first antenna system 34 may, for example, be used for 3G and 4G telecommunication standards.

An active antenna system uses active components 212, for example transistors. The active components may be configured for power and/or phase control.

An active antenna system can, for example, be used at a higher frequency band or where MIMO, massive MIMO or digital beamforming is required.

Figure 8:
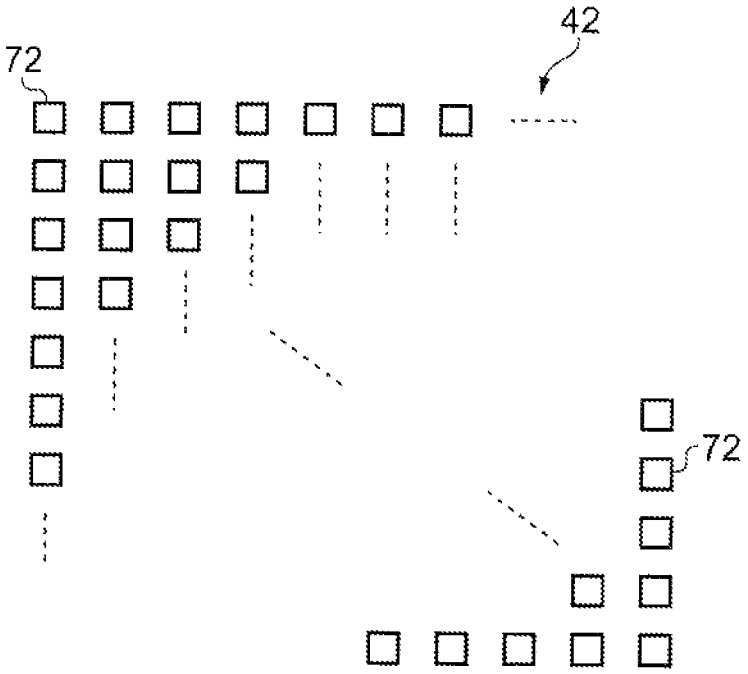
FIG. 8 shows another example embodiment of the subject matter described herein.

In some examples, an active system is a two-dimensional array of radiating elements 72, for example as illustrated inn FIG. 8.

In the example of FIG. 8, the second antenna system 42 comprises a two-dimensional array of radiator elements 72. There may be more than 36 radiator elements, in some examples there may be more than 64, 144, or 1000 radiator elements.

The second antenna system 42 may, for example, be used for the very high band (3.3 to 3.8 GHz).

The second antenna system 42 may, for example, be used for 5G telecommunication standards.

In some but not necessarily all of the examples described above, the first antenna system 34 and the second antenna system 42 both operate at sub-6 GHz frequencies.

The reconfigurable modular antenna system 10 may replace an antenna system that is not reconfigurable and/or not modular.

Where a structural feature has been described, it may be replaced by means for performing one or more of the functions of the structural feature whether that function or those functions are explicitly or implicitly described.

The above described examples find application as enabling components of automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature) or combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

The invention claimed is:

1. A reconfigurable modular antenna system, comprising:

a first antenna module comprising at least a first part of a first antenna system;

a second antenna module comprising at least a second part of the first antenna system and a part of a second antenna system; and an interconnect between the first antenna module and the second antenna module that couples the first part of the first antenna system to the second part of the first antenna system to form the first antenna system, wherein the first antenna system is configured to operate in a first frequency band and the second antenna system is configured to operate in a second frequency band, different to the first frequency band, and wherein the second antenna module is a replaceable antenna module.

2. The reconfigurable modular antenna system as claimed in claim 1 wherein the first antenna module is a replaceable antenna module.

3. The reconfigurable modular antenna system as claimed in claim 1 wherein the second antenna module is configured to be on-site replaceable or wherein the second antenna module and the first antenna module are both configured to be on-site replaceable.

4. The reconfigurable modular antenna system as claimed in claim 1, wherein at least the second antenna module is configured to be replaceable while the first antenna module continues to operate.

5. The reconfigurable modular antenna system as claimed in claim 1, wherein the second antenna module comprises radiator elements that are common between the first antenna system and the second antenna system.

6. The reconfigurable modular antenna system as claimed in claim 1, wherein the second antenna module comprises radiator elements of the first antenna system that are interleaved with radiator elements of the second antenna system.

7. The reconfigurable modular antenna system as claimed in claim 1, wherein the first antenna module comprises radiator elements of the first antenna system interleaved with radiator elements of a third antenna system.

8. The reconfigurable modular antenna system as claimed in claim 6, wherein the interleaving of radiator elements comprises a first array of groups of higher frequency radiator elements, each group of higher frequency radiator elements being configured to lie, within surrounding conductive separation walls, on different arms of group-dependent virtual cross motifs aligned with and inclined at 45° to a common axis; and a second array of groups of lower frequency radiator elements, each group of lower frequency radiator elements being configured to lie, outside one of the surrounding conductive separation walls, and different arms of group-dependent virtual cross motifs aligned with and inclined at 45° to the common axis.

9. The reconfigurable modular antenna system as claimed in claim 1, wherein the first antenna system comprises a passive antenna system and the second antenna system comprises an active antenna system.

10. A replaceable antenna module of a reconfigurable modular antenna system, comprising:

at least a first part of a first antenna system, wherein the first antenna system comprises an interface for an interconnect configured to couple the first part of the first antenna system to a second part of the first antenna system in a second antenna module to form the first antenna system configured to operate in a first frequency band, wherein the modular antenna system comprises at least:

the replaceable antenna module as a first antenna module;

the second antenna module comprising at least the second part of the first antenna system and a part of a second antenna system; and the interconnect between the first antenna module and the second antenna module that couples the first part of the first antenna system to the second part of the first antenna system to form the first antenna system, and wherein the second antenna system is configured to operate in a second frequency band, different from the first frequency band.

11. A replaceable antenna module of a reconfigurable modular antenna system, comprising:

at least a part of a second antenna system; and at least a part of a first antenna system, wherein the first antenna system comprises an interface for an interconnect configured to couple the part of the first antenna system to another part of the first antenna system in another antenna module to form the first antenna system, wherein the first antenna system is configured to operate in a first frequency band, wherein the modular antenna system comprises at least:

the replaceable antenna module;

the another antenna module comprising at least the another part of the first antenna system; and the interconnect between the replaceable antenna module and the another antenna module that couples the part of the first antenna system to the another part of the first antenna system to form the first antenna system, and wherein the second antenna system is configured to operate in a second frequency band, different from the first frequency band.

12. The reconfigurable modular antenna system as claimed in claim 1, wherein the system is housed within a common radome, and comprises mounting hardware configured to enable separate mounting of the first antenna module and the second antenna module.

13. A cellular base station, comprising the reconfigurable modular antenna as claimed in claim 1.

14. The reconfigurable modular antenna system as claimed in claim 10, wherein the second antenna system, being an active antenna system, comprises a two-dimensional array of radiator elements.

15. The reconfigurable modular antenna system as claimed in claim 11, comprising active circuitry configured for digital beam forming.

* * * * *